US008361685B2

(12) United States Patent
Yu et al.

(10) Patent No.: US 8,361,685 B2
(45) Date of Patent: Jan. 29, 2013

(54) SILANE RELEASE LAYER AND METHODS FOR USING THE SAME

(75) Inventors: Robert C. U. Yu, Webster, NY (US); Kent J. Evans, Lima, NY (US); Yuhua Tong, Webster, NY (US); Nancy L. Belknap, Rochester, NY (US); Helen R. Cherniack, Rochester, NY (US); Robert P. Altavela, Webster, NY (US); Edward F. Grabowski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 525 days.

(21) Appl. No.: 12/613,426

(22) Filed: Nov. 5, 2009

(65) Prior Publication Data

US 2011/0104603 A1 May 5, 2011

(51) Int. Cl.
*G03G 15/04* (2006.01)

(52) U.S. Cl. ..... 430/60; 430/58.2; 430/69

(58) Field of Classification Search ..... 430/57.5, 430/58.2, 60
See application file for complete search history.

(56) References Cited

U.S. PATENT DOCUMENTS

| | | | |
|---|---|---|---|
| 3,121,006 | A | 2/1964 | Middleton et al. |
| 4,286,033 | A | 8/1981 | Neyhart et al. |
| 4,291,110 | A | 9/1981 | Lee |
| 4,338,387 | A | 7/1982 | Hewitt |
| 4,464,450 | A | 8/1984 | Teuscher |
| 4,518,669 | A | 5/1985 | Yashiki |
| 4,579,801 | A | 4/1986 | Yashiki |
| 4,587,189 | A | 5/1986 | Hor et al. |
| 4,664,995 | A | 5/1987 | Horgan et al. |
| 4,775,605 | A | 10/1988 | Seki et al. |
| 4,921,773 | A | 5/1990 | Melnyk et al. |
| 5,017,449 | A | 5/1991 | Yoshihara |
| 5,153,094 | A | 10/1992 | Kazmaier et al. |
| 5,166,339 | A | 11/1992 | Duff et al. |
| 5,189,155 | A | 2/1993 | Mayo et al. |
| 5,189,156 | A | 2/1993 | Mayo et al. |
| 5,344,734 | A | 9/1994 | Monbaliu et al. |
| 5,489,496 | A | 2/1996 | Katayama et al. |
| 5,641,599 | A | 6/1997 | Markovics et al. |
| 5,656,407 | A | 8/1997 | Kawahara |
| 5,721,080 | A | 2/1998 | Terrell et al. |
| 5,756,245 | A | 5/1998 | Esteghamatian et al. |
| 6,180,309 | B1 | 1/2001 | Maty et al. |
| 6,200,716 | B1 | 3/2001 | Fuller et al. |
| 6,207,334 | B1 | 3/2001 | Dinh et al. |

OTHER PUBLICATIONS

U.S. Appl. No. 12/486,591, filed Jun. 17, 2009, Robert P. Altavela, et al.
U.S. Appl. No. 12/486,668, filed Jun. 17, 2009, Robert P. Altavela, et al.

*Primary Examiner* — Thorl Chea
(74) *Attorney, Agent, or Firm* — Pillsbury Winthrop Shaw Pittman LLP

(57) ABSTRACT

The disclosed embodiments are directed to processes for removing photoreceptor coatings from a substrate, wherein the photoreceptor coatings disposed over a substrate of an electrophotographic photoreceptor. More specifically, the present embodiments discloses a photoreceptor coatings removal process comprises subjecting an electrophotographic photoreceptor to a stripping solution that separates the coatings from the substrate.

12 Claims, 1 Drawing Sheet

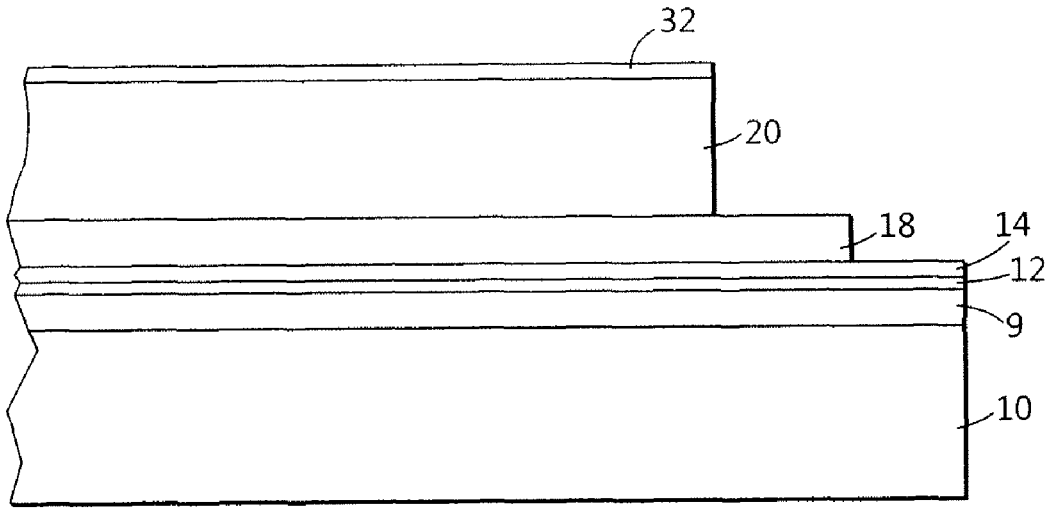
32
20
18
14
12
9
10

SILANE RELEASE LAYER AND METHODS FOR USING THE SAME

CROSS REFERENCE TO RELATED APPLICATIONS

Reference is made to co-pending, U.S. patent application to Belknap et al., filed the same day as the present application, entitled, "A Gelatin Release Layer And Methods For Using The Same" Ser. No. 12/613,461, the entire disclosures of which are incorporated herein by reference in its entirety.

BACKGROUND

This disclosure relates generally to methods for removing photoreceptor coatings from a substrate, wherein the photoreceptor coatings disposed over a substrate of an electrophotographic photoreceptor. More specifically, the present embodiments discloses a photoreceptor coatings removal method which is based on an electrophotographic photoreceptor comprising a silane release layer between the photoreceptor substrate and one or more coating layers. The present embodiments provide a simple yet efficient method for reclaiming recycling or remanufacturing electrophotographic photoreceptors.

In electrophotography, the substrate for photoreceptors in a rigid drum format is required to be manufactured with high dimensional accuracy in terms of straightness and roundness, optimum surface reflectance and roughness, and desired thickness. In order to obtain such a dimensional accuracy, the substrate surface is polished at a high accuracy by using sand blustering, glass bead honing, or a diamond tool and/or the like. Once the substrate surface is formed, at least one coating of photosensitive material is applied to the substrate, which may comprise a charge generation layer and a charge transport layer, or their blended in a single layer, to form a full photoreceptor device.

Current photoreceptor may be commonly comprised of an aluminum substrate having specific dimensions required for straightness, roundness and counter bore concentricity. For example, the wall needs to be minimized for efficient raw material cost but also thick enough to meet the one time machining requirements and physical requirements of the finished photoreceptor device. A defect-free surface with maximum reflectivity is provided by diamond machining to a mirror finish followed by glass bead honing. A maximum surface roughness is also specified. Preparation of the aluminum substrate surface is important in maintaining uniform, defect-free print quality. Minimizing the reflectivity of the surface, eliminates a defect causes by surface reflections that has the appearance of a plywood patterns in half tone areas of prints. Exceeding the maximum surface roughness leads to charge injection and high background.

The final product generally comprises three organic coatings, an undercoat layer (UCL), that functions as a primer, a charge generation and a charge transport, and in some cases, an anti-reflective coating and hole blocking layer. The final assembly has two end caps (or flanges). One end cap comprises a drive gear and the other end cap comprises of a bearing and ground strap that has a spring contact to the bearing shaft and a friction contact to the inner substrate surface. The end caps are held in place with an epoxy adhesive and must meet a specified torque and push out force after a specified thermal cycle test condition.

The fabricated photoreceptor devices are expected to have good electrical and mechanical performance in a copier or printer. But, due to complexity of the manufacturing process, it is unavoidable to have varieties of defects in some photoreceptor devices which may not meet the quality requirements for the copier or printer. The defective devices have to be rejected. In another aspect, each photoreceptive device has limited application life. Once the photoreceptor device cannot function well in the machine, it is also the end of the application life of the device. These used photoreceptor devices were usually disposed in the same way as the defective devices were treated. Disposal of the device could be very costly and could cause lots of environmental issues.

Remanufacturing such a photoreceptor device is difficult because the device dimensions are very specific and minor changes can adversely impact the results. For example, there is a specific balance between the substrate surface reflectance and surface roughness that must be maintained. Moreover, such photoreceptors have wall thicknesses that are too thin to re-machine, the coating layers comprise polymers that are chemically resistant to all but the most aggressive, and often non-environmentally friendly, solvents.

Currently used coating processes are only capable of coating aluminum substrates without flanges. In the case of end of line manufacturing rejects (5 to 15%), most rejected for are coating defects and are not flanged. However, field returns require flange removal before remanufacturing so that recoating can be facilitated by the existing manufacturing process and also to ensure that the flanges would not be too worn out to meet the dimensional requirements of a new or remanufactured photoreceptor. Flange removal without substrate deformation, but with complete adhesive residue removal, is important for maintaining the overall straightness, roundness and concentricity of the final re-manufactured assembly but difficult to achieve with the presently used processes. For example, acids have been known to alter the surface reflectivity of the ground plane making it difficult to control the reflective properties without additional processing. Power-wash or mechanical stripping techniques are also limited by their potential to mar or change the substrate surface.

Moreover, methods to effectively and completely remove coated photoreceptor layers from substrates for re-use are plagued by the necessity to use harsh chemicals including acids or solvents that frequently require large quantities that increase the costs for hazardous waste disposal and may pose safety concerns. A release layer to facilitate the removal of coated layers in an environmentally friendly solvent will reduce the cost of the substrate reclaiming process and result in significant cost savings by enabling substrate re-use.

Thus, there exists a need for methods to recycle or reclaim electrophotographic photoreceptor devices that would address the above-identified problems. Furthermore, there is a need to reduce the cost of remanufacturing electrophotographic photoreceptors, for example, by recycling the non-usable photoreceptor devices, through removing the photosensitive or coating layers without damaging the substrate formation. This would not only reduce the cost of producing the photoreceptor, but also decreases the cost for disposing all related materials in the devices.

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein all incorporated by reference.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are all herein incorporated by reference.

The terms used to describe the imaging members, their layers and respective compositions, may each be used interchangeably with alternative phrases known to those of skill in the art. The terms used herein are intended to cover all such alternative phrases.

SUMMARY

According to aspects illustrated herein, there is provided a method for reclaiming a photoreceptor comprising soaking the photoreceptor in a liquid bath, the photoreceptor comprising a substrate, a silane release layer disposed on the substrate, and one or more coating layers disposed on the silane release layer, and separating the one or more coating layers from the substrate, wherein the silane release layer comprises a silane compound, adhesion promoter and a polycarbonate binder.

In another embodiment, there is provided a photoreceptor comprising a substrate, a silane release layer disposed on the substrate, and one or more coating layers disposed on the silane release layer, wherein the silane release layer comprises a silane compound, adhesion promoter and a polycarbonate binder.

In yet another embodiment, there is provided a photoreceptor comprising a substrate, a silane release layer disposed on the substrate, and one or more coating layers disposed on the silane release layer, wherein the silane release layer is formed from a solution comprising a silane compound, adhesion promoter and polycarbonate binder dissolved in a solvent, the silane compound having the general structure:

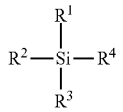

wherein R1, R2, R3 and R4 are independently selected from the group consisting of hydrogen, substituted or unsubstituted, straight, branched or cyclic C1-C24 alkyl, alkoxy, alkenyl, alkenoxy, alkynyl, alkynoxy groups, and further wherein at least one of R1, R2, R3 and R4 is selected from substituted or unsubstituted, straight, branched or cyclic C1-C24 alkyl, alkenyl or alkynyl groups, and at least one of R1, R2, R3 and R4 is selected from alkoxy, alkenoxy or alkynoxy groups.

BRIEF DESCRIPTION OF THE DRAWINGS

For a better understanding, reference may be had to the accompanying FIGURE.

The FIGURE illustrates an electrophotographic photoreceptor showing various layers in accordance with the present embodiments.

DETAILED DESCRIPTION

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size, or location.

This disclosure relates generally to environmentally-friendly methods for removing photoreceptor coatings from a substrate, wherein the photoreceptor coatings disposed over a substrate of an electrophotographic photoreceptor. More specifically, the present embodiments discloses a photoreceptor coatings removal method which is based on an electrophotographic photoreceptor comprising a silane release layer between the photoreceptor substrate and one or more coating layers.

Flange removal without substrate deformation, but with complete adhesive residue removal, is important for maintaining the overall straightness, roundness and concentricity of the final re-manufactured assembly but difficult to achieve with the presently used processes. For example, acids have been known to alter the surface reflectivity of the ground plane making it difficult to control the reflective properties without additional processing. Power-wash or mechanical stripping techniques are also limited by their potential to mar or change the substrate surface.

Moreover, methods to effectively and completely remove coated photoreceptor layers from substrates for re-use are plagued by the necessity to use harsh chemicals including acids or solvents that frequently require large quantities that increase the costs for hazardous waste disposal and may pose safety concerns. A release layer to facilitate the removal of coated layers in an environmentally friendly solvent will reduce the cost of the substrate reclaiming process and result in significant cost savings by enabling substrate re-use. Thus, the present embodiments provide an environmentally-friendly and simple yet efficient method for reclaiming recycling or remanufacturing electrophotographic photoreceptors.

FIG. 1 illustrates a typical electrophotographic photoreceptor showing various layers and having a drum configuration. As can be seen, the exemplary imaging member includes a rigid support substrate 10, an electrically conductive ground plane 12, an undercoat layer 14, a charge generation layer 18 and a charge transport layer 20. The rigid substrate may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The charge generation layer 18 and the charge transport layer 20 forms an imaging layer described here as two separate layers. In an alternative to what is shown in the figure, the charge generation layer may also be disposed on top of the charge transport layer. Other layers of the imaging member may include, for example, an optional over coat layer 32. Overcoat layers are commonly included to increase mechanical wear and scratch resistance to prolong the life of photoreceptor device. In the present embodiments, a release layer 9 is also included and is located between the substrate 10 and the other coating layers 12, 14, 18, 20, 32. Release layer is located between the groundplane 12 and the undercoat layer 14. It will be appreciated that the functional components of these layers may alternatively be combined into a single layer.

The Substrate

An electrically conducting substrate may be any metal, for example, aluminum, nickel, steel, copper, and the like or a polymeric material, filled with an electrically conducting substance, such as carbon, metallic powder, and the like, or an organic electrically conducting material. In certain embodiments, the substrate is made from aluminum or an aluminum alloy.

The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or, of a minimum thickness of less than a millimeter. Similarly, a flexible belt may be of substantial thickness, for example, about 250 microns, or of minimum thickness less than 50 microns, provided there are no adverse effects on the final electrophotographic device. The wall thickness of the drum substrate is manufactured to be at least about 0.25 mm to fulfill the physical requirements of the photoreceptor device. In one embodiment, the thickness of the substrate is from about 0.25 mm to about 5 mm. In one embodiment, the thickness of the substrate is from about 0.5 mm to about 3 mm. In one embodiment, the thickness of the substrate is from about 0.9 mm to about 1.1 mm. However, the thickness of the substrate can also be outside of these ranges.

The surface of the substrate is polished to a mirror-like finish by a suitable process such as diamond turning, metallurgical polishing, glass bead honing and the like, or a combination of diamond turning followed by metallurgical polishing or glass bead honing. Minimizing the reflectivity of the surface may eliminate defects caused by surface reflections that have the appearance of a plywood patterns in half tone areas of prints. Exceeding certain surface roughness, for example, 5 microns, may lead to undesirable and non-uniform electrical properties across the device, which cause poor imaging quality. In certain embodiments, the surface roughness of the substrate is controlled to be less than 1 microns, or less than 0.5 microns.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

The Release Layer

In the present embodiments, there is provided a silane release layer 9 disposed on the substrate. The silane release layer is positioned between the groundplane and the other coating layers and may have a thickness of from about 1.5 micron to about 3 microns.

The silane release layer provides a method for reclaiming or recycling manufacturing coating rejects as well as for re-manufacturing of the photoreceptors returned from the field. The silane release layer allows recovery of the substrate for use in re-fabrication of photoreceptors and significantly reduces photoreceptor production cost. In embodiments, the silane release layer comprises a silane compound, an adhesion promoter, and a polycarbonate, and the silane may have the general structure:

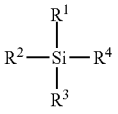

wherein R1, R2, R3 and R4, independently, are selected from the group consisting of hydrogen, substituted or unsubstituted, straight, branched or cyclic C1-C24 alkyl, alkoxy, alkenyl, alkenoxy, alkynyl, alkynoxy groups, with the condition that at least one of R1, R2, R3 and R4 must be selected from substituted or unsubstituted, straight, branched or cyclic C1-C24 alkyl, alkenyl or alkynyl groups, and at least one of R1, R2, R3 and R4 must be selected from alkoxy, alkenoxy or alkynoxy groups. It is preferred that the substitution functional groups in R1, R2, R3 and R4 be optionally hydroxyl, carboxylic acid, ester, carbonate or thiol. In a specific embodiment, the silane is gamma aminopropyltriethoxy silane.

In the present embodiments, the adhesion promoter may be, for example, VITEL PE-200 (V2200 available from Bostik, Inc. (Middleton, Mass.)). This polyester resin is a linear saturated copolyester of two diacids and two diols where the ratio of diacid to diol in the copolyester is 1:1. The diacids are terephthalic acid and isophthalic acid. The ratio of terephthalic acid to isophthalic acid is 1.2:1. The two diols are ethylene glycol and 2,2-dimethyl propane diol. The ratio of ethylene glycol to dimethyl propane diol is 1.33:1. The Goodyear PE-200 linear saturated copolyester consists of randomly alternating monomer units of the two diacids and the two diols in the above indicated ratio and has a weight average molecular weight of about 45,000 and a Tg of about 67° C.

In the present embodiments, the polycarbonate may be, for example, a polycarbonate (4,4'-cyclohexylidenebisphenol), having a weight average $M_w$ of from about 10,000 to about 100,000. In specific embodiments, the polycarbonate may be a polycarbonate (4,4'-cyclohexylidenebisphenol), having a weight average $M_w$ of about 20,000. The release layer is formed from a solution of the silane compound, adhesion promoter, and polycarbonate being dissolved in a solvent or mixture of solvents. In one embodiment, the solution comprises the silane compound, adhesion promoter, and polycarbonate in a weight ratio range of from about 100:1:1 to about 1:50:100 dissolved in a mixture of tetrahydrofuran/toluene with a weight ratio of from about 10:1 to about 1:10. In a specific embodiment, the polycarbonate is in a 2:1:1 weight ratio dissolved in a mixture of tetrahydrofuran/toluene in a 70:30 weight ratio. The solids were dissolved with gentle agitation at a temperature of from about 0° C. to about 100° C., for a final solution of about 10 wt % of solid content.

In embodiments, the silane is present in the release layer in an amount of from about 1 percent to about 99 percent, or from about 5 percent to about 80 percent, or from about 10 percent to about 50 percent by weight of the total weight of the release layer. In further embodiments, the adhesion promoter is present in the release layer in an amount of from about 0.1 percent to about 90 percent, or from about 1 percent to about 50 percent, or from about 2 percent to about 30 percent by weight of the total weight of the release layer. In yet further embodiments, the polycarbonate is present in the release layer in an amount of from about 1 percent to about 99 percent, or from about 5 percent to about 80 percent, or from about 10 percent to about 50 percent by weight of the total weight of the release layer.

In embodiments, the substrate and counter bore is first coated with the silane solution prior to applying the coating layers on the photoreceptor. The thin pre-coated silane release layer is obtained after drying and provides good adhesion to the substrate, good bonding to the UCL layer and good bonding to the end caps. Moreover, the silane release layer will be soluble in inexpensive and non-toxic solvents which provides easy substrate recovery processing.

Thus, the present embodiments provide for an improved method of removal of all the photoreceptor coating layers and flanges from the counter bore for efficient substrate recovery without substrate damage. Use of the silane release layer in the present methods facilitates a stripping process that does not alter the surface characteristics of the substrate or the dimensional integrity of the reclaimed substrate. In addition, the method uses environmentally friendly solvents and not the toxic solvents generally required for stripping the photoreceptor coating layers. Other methods of removing photoreceptor layers are disclosed in U.S. patent application Ser. No. 12/486,591 and U.S. patent application Ser. No. 12/486,668, the entire disclosures thereof being incorporated herein by reference.

In embodiments, the coating layers are released and removed from the substrate by immersing and soaking the entire photoreceptor in a solvent such as, for example, isopropanol or water, at room temperature or elevated temperature for about 1 minute to about 72 hours hours to allow liquid penetration. In other embodiments, the solvent may be ARMAKLEEN (available from The ArmaKleen Company, Princeton, N.J.) or NATRASOLVE (available from Johnson-Diversey Inc., Sturtevant, Wis.). The liquid bath is slightly agitated to encourage dissolution of the silane release layer. Following the liquid bath soak, the plurality of coating layers from the substrate may be separated by peeling the plurality of coating layers off or by scraping the plurality of coating layers away. If the flanges are present, the flanges can be separated from the substrate by peeling, scraping and removing actions can be performed by hand or using a tool such as a razor, doctor blade, skive, brushes, scrubbing pads. The flanges can be removed by applying torque and pull force to grippers or by impact using a bar or rod inserted in one end. The coating layers may be degraded partially or completely. Typically, the flanges are damaged or degraded partially and may not be re-usable after soaking. The recovered substrate can subsequently be used for re-manufacturing. As substrates, such as aluminum substrates, represent about 50 percent of photoreceptor raw materials cost in the manufacture of organic photoreceptors, the present embodiments facilitate a significant cost savings.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micron to about 10 microns or from about 1 micron to about 10 microns, or in a specific embodiment, about 3 microns. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micron, or no more than 10 microns, and in further embodiments have a thickness of at least about 2 microns, or no more than 6 microns.

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl)gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and may have a thickness of from about 1 micron to about 23 microns. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of less than 1 μm, or about 0.25 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 15 microns to about 50 microns, and more specifically, of a thickness of from about 15 microns to about 40 microns. Examples of charge transport components are aryl amines of the following formulas/structures:

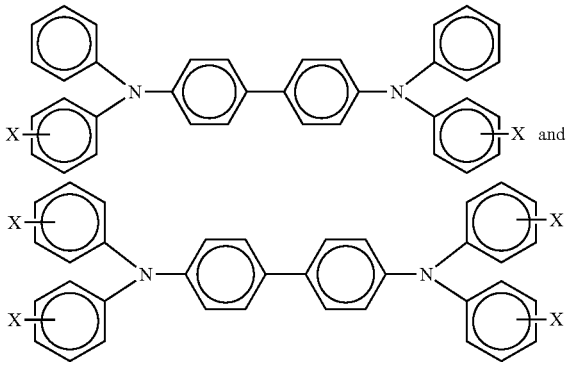

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

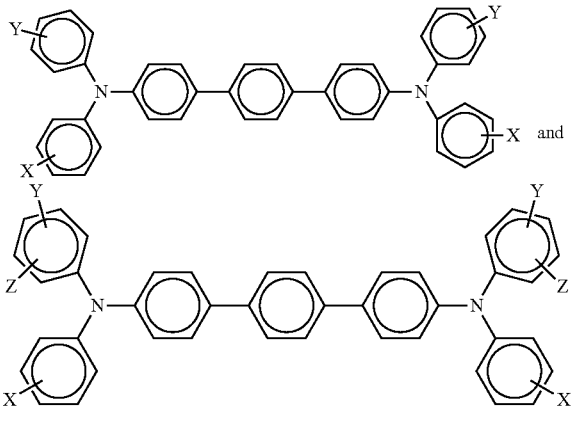

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N-bis (alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate)methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Adhesive Layer

An optional separate adhesive interface layer may be provided in certain configurations, such as for example, in flexible web configurations. In the embodiment illustrated in FIG. 2, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 microns, or no more than about 900 microns after drying. In embodiments, the dried thickness is from about 0.03 microns to about 1 micron.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 microns generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 microns, or no more than about 42 microns, or of at least about 14 microns, or no more than about 27 microns.

The Anti-Curl Back Coating Layer

The anti-curl back coating 1 may comprise organic polymers or inorganic polymers that are electrically insulating or slightly semi-conductive. The anti-curl back coating provides flatness and/or abrasion resistance.

Anti-curl back coating 1 may be formed at the back side of the substrate 2, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 microns, or no more than about 35 microns, or about 14 microns.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

The present embodiments will be described in further detail with reference to the following examples and comparative examples. All the "parts" and "%" used herein mean parts by weight and % by weight unless otherwise specified.

Several exemplary stripping solution conditions of the present embodiments were studied in the following examples.

Example 1

Formulation of Silane Release Layer

The release layer solution was made by combining gamma aminopropyltriethoxy silane, VITEL PE-200 adhesion promoter, polycarbonate (4,4'-cyclohexylidenebisphenol), having a weight average $M_w$ of about 20,000, in a 2:1:1 weight ratio dissolved in tetrahydrofuran/toluene in a 70:30 weight ratio. The solids were dissolved with gentle agitation at room temperature for a final solution of about 10 wt % of the solid content.

Photoreceptor Construction

Multi-layered photoreceptor devices were prepared on a cleaned aluminum drum with two thicknesses of the release layer. The release layer was tsukiage-coated using pull rates of 100 and 225 millimeters/minute and dried for either 10 or 20 minutes at 120° C. to achieve a dry film thickness of from about 1.5 micron to about 3 microns. The following layers were subsequently coated on the release layer and a bare aluminum substrate as a control.

An undercoat layer of a titanium oxide/phenolic resin dispersion comprised of 62 weight percent titanium dioxide (MT150W™, available from Tayca Company (Osaka, Japan)), and 38 weight percent phenolic resin (VARCUM™ 29159, $M_w$ about 3,600, viscosity about 200 cps, available from OxyChem Company (Dallas, Tex.)) in a 1:1 weight mixture of 1-butanol and xylene, and subsequently dried at 165° C. for 15 minutes. The resulting undercoat layer (UCL) had a dry thickness of 10 microns.

A charge generator layer comprises of a chlorogallium pigment, a vinyl chloride-vinyl acetate copolymer (VMCH) binder dispersion in a 54:46 weight ratio suspended in n-butyl acetate solvent was subsequently applied to the undercoat layer.

Finally, a charge transport layer coating solution was applied utilizing a dip coating process with a solution comprised of 40 weight percent N,N'-bis(4-methylphenyl)-N,N'-bis[4-(n-butyl)phenyl]-[p-terphenyl]-4,4"-diamine (TPD), 60 weight percent poly(4,4'-dihydroxy-diphenyl-1-1-cyclohexane, $M_w$=40,000 (PCZ400) available from Mitsubishi Gas Chemical Company, Ltd. (Tokyo, Japan), about 1 percent by weight antioxidant, about 7% polytetrafluoroethylene (PTFE) particles (including surfactant to disperse the PTFE) in toluene:THF solvent system at 25:75 weight ratio. A pull rate of 180 millimeters/minute yields a charge transport layer thickness of 32 micrometers.

Additional layers include a $TiO_2$-based UCL in the range of 1-18 microns and ZnO-based UCL in the range of 15-28 micron (3 component UCL).

Performance Testing

The full devices were electrically tested in a cyclic scanner. The release layer devices demonstrated good linear charging and identical low field depletion as the control prepared without the release layer.

Field testing of the devices to simulate photoreceptor life and to stress the UCL at elevated field was also performed. The data was normalized to a nominal $V_o$ of 700V, and reflected the change in photo-induced discharge characteristics (PIDC) curve expected as charge transport layer thickness wears. The nominal starting thickness for these devices was 30 microns—shallower PIDC curves where seen with the 20 microns and 17 microns simulated thickness. Even at higher field stress the release layer remains undetected in electrical performance and exhibits excellent discharge characteristics.

Full devices with and without the release layer coating were stripped using an isopropanol bath at 72° C. The devices coated with the release layer demonstrated complete removal of the coated layers after 3 hours of soaking while a significant portion of the coating remained on the substrate in the control sample without the release layer.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

What is claimed is:

1. A photoreceptor comprising an electrically conductive substrate;

a ground plane layer disposed on the substrate;

a silane release layer disposed on the ground plane layer; and one or more coating layers selected from the group consisting of an overcoat layer, a hole blocking layer, a charge generation layer, a charge transport layer, an adhesive layer, a ground strip layer, and an anti-curl back coating layer disposed on the silane release layer, wherein the silane release layer comprises a silane compound, adhesion promoter and a polycarbonate binder.

2. The photoreceptor of claim 1, wherein the substrate is aluminum.

3. The photoreceptor of claim 1, wherein the silane compound has the general structure:

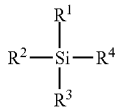

wherein R1, R2, R3 and R4 are independently selected from the group consisting of hydrogen, substituted or unsubstituted, straight, branched or cyclic C1-C24 alkyl, alkoxy, alkenyl, alkenoxy, alkynyl, alkynoxy groups, and further wherein at least one of R1, R2, R3 and R4 is selected from substituted or unsubstituted, straight, branched or cyclic C1-C24 alkyl, alkenyl or alkynyl groups, and at least one of R1, R2, R3 and R4 is selected from alkoxy, alkenoxy or alkynoxy groups.

4. The photoreceptor of claim 1, wherein the silane compound is gamma aminopropyltriethoxy silane.

5. The photoreceptor of claim 1, wherein the silane is present in the silane release layer in an amount of from about 1 percent to about 99 percent by weight of the total weight of the silane release layer.

6. The photoreceptor of claim 1, wherein the adhesion promoter is present in the silane release layer in an amount of from about 0.1 percent to about 90 percent by weight of the total weight of the silane release layer.

7. The photoreceptor of claim 1, wherein the polycarbonate binder is present in the silane release layer in an amount of from about 1 percent to about 99 percent by weight of the total weight of the silane release layer.

8. The photoreceptor of claim 1 further comprising flanges connected to either end of the photoreceptor substrate.

9. The photoreceptor of claim 1, wherein the silane release layer has a thickness of from about 1.5 micron to about 3 microns.

10. The photoreceptor of claim 1, the silane compound, adhesion promoter, and polycarbonate are in a weight ratio range of from about 100:1:1 to about 1:50:100.

11. A photoreceptor comprising an electrically conductive substrate;

a ground plane layer;

a silane release layer disposed on the ground plane layer and one or more coating layers selected from the group consisting of an overcoat layer, a ground plane layer, a hole blocking layer, a charge generation layer, a charge transport layer, an adhesive layer, a ground strip layer, and an anti-curl back coating layer disposed on the silane release layer, wherein the silane release layer is formed from a solution comprising a silane compound, adhesion promoter and polycarbonate binder dissolved in a solvent, the silane compound having the general structure:

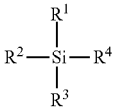

wherein R1, R2, R3 and R4 are independently selected from the group consisting of hydrogen, substituted or unsubstituted, straight, branched or cyclic C1-C24 alkyl, alkoxy, alkenyl, alkenoxy, alkynyl, alkynoxy groups, and further wherein at least one of R1, R2, R3 and R4 is selected from substituted or unsubstituted, straight, branched or cyclic C1-C24 alkyl, alkenyl or alkynyl groups, and at least one of R1, R2, R3 and R4 is selected from alkoxy, alkenoxy or alkynoxy groups.

12. The photoreceptor of claim 11, wherein the solvent is selected from the group consisting of tetrahydrofuran, toluene, and mixtures thereof.

* * * * *